United States Patent [19]

Finkbeiner

[11] 3,994,474

[45] Nov. 30, 1976

[54] DEVICE FOR LIFTING VEHICLES

[76] Inventor: Walter Finkbeiner, Wittlensweiler Strasse, 792 Freudenstadt, Germany

[22] Filed: Oct. 7, 1975

[21] Appl. No.: 620,302

[30] Foreign Application Priority Data

Oct. 19, 1974 Germany ..... 2449815

[52] U.S. Cl. ..... 254/88; 254/93 HP

[51] Int. Cl.[2] ..... E02C 3/00

[58] Field of Search ..... 254/93 HP, 8 R, 8 B, 254/8 C, 9 R, 9 B, 9 C, 88

[56] References Cited

UNITED STATES PATENTS

| | | | |
|---|---|---|---|
| 2,404,577 | 7/1946 | Jackson | 254/8 B |
| 3,174,722 | 3/1965 | Alm | 254/93 HP |
| 3,379,411 | 4/1968 | Vanderjagt | 254/8 B |
| 3,521,861 | 7/1970 | Freudenthal et al. | 254/93 HP |
| 3,758,076 | 9/1973 | Tranchero | 254/8 R |

*Primary Examiner*—James L. Jones, Jr.
*Assistant Examiner*—Robert C. Watson

[57] ABSTRACT

Onto a rectangular bottom frame a lifting platform is hinged by a parallelogram guiding linkage to move vertically above the bottom frame. Between the lifting platform and the bottom platform an air bellows is fitted. A wedge plate is connected at one edge to the lifting platform to move up and down at that edge with the bottom platform while the opposite edge is drawn back and forth along a guide on the bottom platform. The wedge plate forms one side of the parallelogram and the guide forms a second side. The forward edge of the wedge plate is pivotable with respect to its remainder and cooperates with detents extending from the bottom platform to lock the lifting platform in elevated positions. The device travels on wheels which pass into the bottom platform as the bottom platform is urged to the ground under the weight of the vehicle.

35 Claims, 9 Drawing Figures

DEVICE FOR LIFTING VEHICLES

The invention relates to a device for the lifting of very heavy vehicles by means of compressed air.

City buses travel without spare wheels. Their front tires cannot be twin tires. If the tires have a flat, the wheel must be changed on the spot. With a flat, the bus drops by 10 – 20 cm. The body drops by the same amount; since the bottom edge of a bus body is low anyhow, the bus with the body almost hits the ground. This makes it difficult to find a location for inserting the lifting device which will lift the bus sufficiently so that the wheel may be changed. In contrast to a repair shop, the weakness of the roadway often presents difficulties. Also, the roadway is often not even. There are also difficulties with providing the type of energy to lift the bus. It is very expensive to have a crane-equipped vehicle stay with the bus till the repair is finished, because the bus must first be jacked up and, after the repair, must be let down.

Also, depending on the manufacturer of the vehicle, the areas where the lifting devices can be applied differ, so that only specially designed lifting devices can be used for lifting.

Even in truck terminals and repair shops it is difficult to lift very heavy vehicles in an economic manner from the location where they happen to be. They must be driven over pits or lift gantries must be placed next to them. It may happen that one can only get a grip on the wheels. In this case, the axles are free, but the wheels are not. Or, the devices get a grip on the axles and only the wheels are free, but not the axles. Frequently the devices make it necessary to lift the entire vehicle and lifting, e.g., of the rear axle by itself is not possible, even though work must only be done in the area of the rear axle.

Frequently there arise problems regarding observation of safety precautions.

Also, frequently the lifting device must remain with the vehicle while work is being done on the vehicle and during this time the lifting device cannot be used.

The same applies with the lifting of containers.

To be sure, there are transportable lifting devices for very heavy vehicles. But often these devices are, nevertheless, so difficult to move that the repair personnel prefers to drive the vehicle to the lifting device which, per se, could be moved.

Well-known lifting devices also cannot be used universally because they are bulky, several sections must be connected to each other before use, they are difficult to maneuver to the proper location, they are voluminous so that they are difficult to transport and they are also expensive.

Most lifting devices are suited either for wheeled vehicles or track-laying vehicles.

There is no simple, easy to operate, inexpensive, flat, sufficiently narrow and short, easily movable, universally usable and rugged lifting device, having few components and requiring reasonable amounts of energy, for very heavy vehicles which permits economic operation.

It is an object of the present invention to create such a lifting device.

The objects of the present invention are achieved as follows:

a. A steel welded construction has a stable bottom frame of rectangular shape.

b. Via a guide construction a lifting platform is jointed flexibly; this platform is located above a partial area of the bottom frame and can be moved at right angles to the bottom frame and parallel to itself.

c. The lifting platform has a width sufficient for the width of the contact area of conventional truck twin tires and a length corresponding to the contact area.

d. Between the lifting platform and the bottom frame there is an air bellows whose top side is connected to the lifting platform and whose bottom side is connected to the bottom frame.

e. A wedge plate is connected on its lengthwise side flexibly jointed to the drive-on side of the lifting platform, can be moved up and down on this lengthwise side together with the lifting platform; at the length-wise side close to the ground, it is guided actively or passively by the bottom frame in proximity to the ground.

f. At a certain elevation of the lifting platform, it can be secured against lowering by a disconnectable locking device.

g. The device travels on wheels which under the vehicle load assume an alternate position.

In the following discussion, the reference numerals refer to the numerals used in the detailed description of the drawings.

Said ground frame 12 has underneath said air bellows 16 an airtight plate means 27, 38 fully in contact with said air bellows, which plate means reinforces the ground frame 12 and constitutes the ground plate 27 for mounting the lower peripheral area of said air bellows 16.

By this means, one can create with the plate device both a counterpart for the air bellows and also stiffen the bottom (ground) frame. One also obtains a surface to which wheel mountings, relief pressure valves, compressed air lines etc. can be fastened in a safe and solid manner.

Said ground plate 27 is spaced from the bottom side of said ground frame 12.

By this means one can accomplish that the device becomes more stable (steady). If the ground plate were also in contact with the ground, it might — depending on the unevenness — have to take the entire load and it would have to be made much stiffer than it would have to be as counterpart for the air bellows. In addition, other items, such as the relief pressure valve, lines, etc. can be accommodated in the resulting space.

Said lifting platform 13 is connected above said air bellows 16 airtight and constitutes the cover plate for mounting the upper peripheral area 67 of said air bellows 16.

By this means, the height becomes low owing to the absence of any intermediary members. In addition, the lifting platform itself is supported directly by the air bellows over a large area, so that, in comparison, it must take a lesser load. One also save components if one uses the lifting platform simultaneously as cover plate and the fastening and unfastening of the mounting for the air bellows is simple, because the necessary screws are freely accessible.

Said air bellows 16 is a compressed-air bellows conventional with air-suspension vehicles, which air bellows is open at its ends and has mounting rings 63, 67 for securing its rim to a ground plate 27 and to said lifting platform 13.

By this means, one can use the standard, inexpensive and widely available compressed air bellows which are ideally suited for the solution of the problem here at hand since they must take loads of a similar order of magnitude under rugged operating conditions. Hence they are, so to speak, designed for this type of use.

Said air bellows 16 is located in the exact center and beneath said lifting platform 13.

By this means, a single wheel or a twin tire standing in the middle of the lifting plate does not tilt the construction, and the tilting forces, taking the statistical mean value, are kept low, even though small deviations are present.

The minimum design height is determined by the height of said ground frame 12 plus the height of said lifting platform 13. By this means, one achieves a flat device which can be slid under the body of a very low-slung vehicle or below the bottom edge of a container.

The distance between the top side of said plate device 27, 38 and the bottom side of said lifting platform 13 is determined by the minimum design height of said air bellows 16 having a single intermediate ring 66.

By this means, one achieves, on the one hand, the necessary lifting height, because the lifting height of two air bellows having intermediate rings is not utilized; on the other hand, the air volume to be introduced into the air bellows is small. Thirdly, an air bellows with a single intermediate ring in the collapsed condition has a low height, so that, as a result, the device is low. Finally, one obtains an appreciable safety distance between the bottom side of the ground frame and the plate device, so that even large unevennesses do not matter.

In continuation of said wedge plate 14 in the direction towards the ground, a narrow wedge strip 24, 26 with a box section, is rigidly fastened to said ground frame 12.

By this means, one achieves, first, a stiffening of the ground frame. Above all, the area most exposed to loads while driving on remains immovable and therefore very able to bear the load. The "edge" of the wedge then is immovable and the guideways of the remaining part of the wedge plate need not be oversized so much.

Two wheels 31, 32 are located next to each other on said device, said wheels having an axis of rotation, seen from the forward side of said wedge plate located behind the overall center of gravity 119 of the entire device when the latter has its lowest height.

By this means, one can rotate the device about its vertical axis and, in addition, the device always rests on the wedge's edge. If the wedge's edge had the possibility of inclining somewhat in the upward direction, a tire driven onto the device would push the device in front of it. However, if one incorporates this improvement, the driven-on tire presses the wedge's edge at once against the ground and secures the entire device in position.

The mean (average) wedge angle is about 15° and at the most 20°.

By this means, one achieves a low device; vehicles practically driving on their wheel rims can drive onto the wedge and one prevents that the device is slid in front of it by the driven-on wheel which would be the case if the wedge angle were too large.

The wedge area, seen from the top, is about as large as the area of said lifting platform 13.

By this means, the device as a whole remains small, the lifting platform is sufficiently large and the wedge length is sufficiently long to assure a gradual drivingon.

Said locking device 61, 62, 113 comprises detents cooperating with a forwardly disposed edge said wedge plate 14, which is lockable behind said detents 58, 59 which detents are immovable in the lengthwise direction of the device and are connected shear-free to said ground frame 12.

By this means, no special locking device is required and the wedge plate is doubly utilized, since, on the one hand, it provides the surface of the wedge and, on the other hand, it is the locking plate itself.

Said detents 58, 59 are rigidly connected to the ground frame 12 and said forwardly disposed edge on said wedge plate 14 can be moved up and down.

By this means, one avoids having to make the detents movable, which would require an additional, movable, highly stressable bearing device and only would make the wedge plate movable. With this means, the problems occurring with high loads are not particularly great, because they are used as locking devices only when the vehicle has already been lifted. Then the vehicle no longer stands on the wedge plate and the wedge plate no longer has to take the direct vehicle load.

Said wedge plate 14 comprises two plate sections 98, 113, the rear plate section being several times the length of the forward plate section, the rear edge of the rear plate section being immovable in the horizontal direction, the forward plate section being hinged to the forward edge of the rear plate section 98 and can be moved up and down at its forward edge 118 about the hinge axis 114.

By this means, one achieves that only the forward part of the wedge plate must be movable up or down, which reduces the bearing problems for the larger rear section plate. Also, the shearing force in the wedge plate is better redirected into the horizontal direction and the guidance of the wedge plate is simplified.

A spring device 116 can lock said forward plate section 113 in its upper position, disconnected from detents 61, 62.

By this means, the lowering operation is simplified, because the locking device can remain disconnected all the time and accidental dropping into a detent during lowering is avoided. In that case, one would have to pump the air bellows up again, the interlock would have to be released and one would have to continue releasing the air from the air bellows. Furthermore, a driving-off wheel can cause the locking device to drop into the detent position, so that during the next driving-on the locking device is ready for use.

Said forward plate section 113 with its forward edge is preferably moved by its own weight.

By this means, the locking device is made operative automatically and lowering can only be made to a level corresponding to the detent position.

The device height is approximately 10 to 20 cm, preferably 15 cm.

By this means, one obtains a device which is still sufficiently flat and low to get below the lowest part of vehicles, containers, etc. and still has sufficient volume to accommodate the necessary components and to make them sufficiently strong.

Said lifting plate 13 and said wedge plate 98 each form one side of a parallelogram, a main lever forms the third side of the parallelogram, said main lever 81,

82 having a high bending moment in the vertical direction; the rear end of said main lever is hinged in the rear area of said lifting platform 13 and the forward end is hinged to said horizontally guiding portion 48, 49, 84, 86; guide rods 84, 86 forming the fourth side of the parallelogram said guide rods 84, 86 extending from the forward end of said main levers 81, 82 to the forward area of the said wedge plate, which is vertically immovable.

By this means, one utilizes the lifting platform and the edge plate simultaneously as parts of the parallelogram and requires few additional parts for the completion of the parallelogram.

Said horizontally guiding portion 48, 49, 84, 86 is pivotably connected to said wedge plate.

By this means, one utilizes the horizontal guidance device simultaneously as guidance device for the parallelogram.

Said horizontally guiding portion 48, 49, 84, 86 includes lengthwise guide rails 48, 49 rigidly connected to said ground frame 12 and said guide rods 84, 86 are guided by these rails.

By this means, one strengthens the ground frame through the lengthwise guide rails and the stiffness of the overall combination becomes greater than the individual stiffnesses. In addition, the ground frame can also take part of the bending forces acting on the lengthwise guide rail. Finally, the lengthwise guide rail transmits the resulting forces to a large area of the ground frame.

For parallel and vertical guidance for said lifting platform 13, steering levers 92, 93 are provided whose rear end is hinged in the rear area of said ground frame vertically below the pivot axis of said main levers and in straight extension of said guide rod, and whose forward end is hinged at said main levers 81, 82 in their effective center 89, 91 and wherein the effective length of said steering levers 92, 93 is exactly equal to the effective length of the main lever 81, 82 from the pivot axis of said main lever and said steering lever to the pivot axis of said main lever and said horizontally guiding portion.

By this means, one avoids troublesome and expensive telescope devices with which it is difficult to take large forces (loads). This type of parallel and vertical guidance in a simple manner supplements parallelogram guidance.

Each steering lever 92, 93 comprises two parallel shackles which are spaced apart and between which said main lever 81, 82 is accommodated.

By this means, one can locate the main lever in the center of the lengthwise strut of the ground frame; the forces acting from the steering lever on the main lever can be taken symmetrically and one arrives at a design which in the lowered condition saves space.

Said ground frame 12 has on its outward sides lengthwise hollow sections open at least in the upward direction, which hollow sections can accommodate at least up to part of their height said main lever 81, 82, said horizontally guiding portion 48, 49, 84, 86 and said steering levers 92, 93.

By this means, the ground frame can, one, be made rigid, two, its height can be made low, and three, lever, guides, supports, etc. can safely be located inside it.

The majority of moving joints are symmetrical joints.

By this means, one achieves that the already highly stressed components are stressed symmetrically at their joints and are practically not stressed in torsion.

At least two pairs of detents 58, 59 are provided whose position corresponds to two different working elevations of said lifting platform 13.

By this means, one achieves that the locking device has two detent locations and that one may operate at different fixed levels.

In the center region 107 of said lifting platform 13 coaxially with the air bellows, there is provided an airtight recess 68 to accommodate a fitting 21 of load lifting members such as a horn plate 122 and the like.

By this means, one can take hold of loads to be lifted also at axles, projections, etc. and the resulting forces are applied centrally and symmetrically.

Preferably on both of said sides of said lifting platform 13 there are located mounting supports 124 for roll-off blocks 127, 128.

By this means, a vehicle wheel cannot just roll over the lifting platform.

At the rear end of the device an inactive drive-off wedge 18 is attached.

By this means, continuous operation is achieved. On the one side, the wheel can roll on, is lifted and after lowering it can roll off in the same direction, so that one axle after the other — for example with a multi-axle wheel or track-laying vehicles — can be lifted.

At the forward and rear ends of the device a hitching location 43, 44 for a removable drawbar is provided.

By this means, a single operator can easily move the device anywhere without the drawbar later interfering with the work.

The obtuse parallelogram angle in its first lifting position is 130° to 145° and in its second lifting position is 125° to 110°.

By this means, one obtains spatial relations, which, on the one hand, permit widely differing lift positions, and, on the other hand, especially in the lower lifted position, do not put too much of a load on the device, because as soon as the air bellows is evacuated, the lever supports and other components must take the resulting forces which increase, depending on the trigonometric functions, the more obtuse the parallelogram angle is.

The height of the device in the lowest condition is about 15 cm, at the highest elevation is 40 to 50 cm, preferably about 45 cm, and in the middle position is 31 to 41 cm, preferably about 36 cm, with the load capacity in the first case at about 6,000 kp and in the second case about 4,000 kp.

By this means, one can obtain in practice construction heights, lifting heights and lifting capacities of interest for application.

Only a single air bellows 16 is provided.

By this means, one combines a comparatively narrow construction width with a high lifting capacity and few design elements.

At least that section 98 of said wedge plate 14 constituting part of the parallelogram has an extremely torsion-resistant box section.

By this means, one strengthens the design at a location where the most design volume is available, relieves the load on the joints, prevents a tilting of the lifting platform by even small amounts, and keeps the main lever free from torsion forces.

Further advantages and characteristics of the invention will be described by means of a preferred embodiment.

Figure 1:
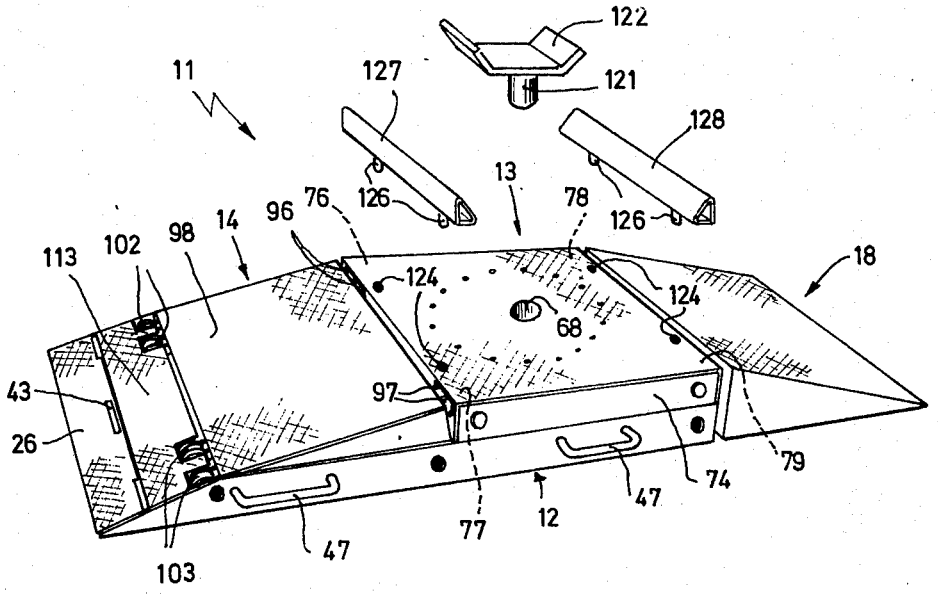
FIG. 1 shows a perspective view of the device lowered with attached drive-off wedge.
Figure 2:
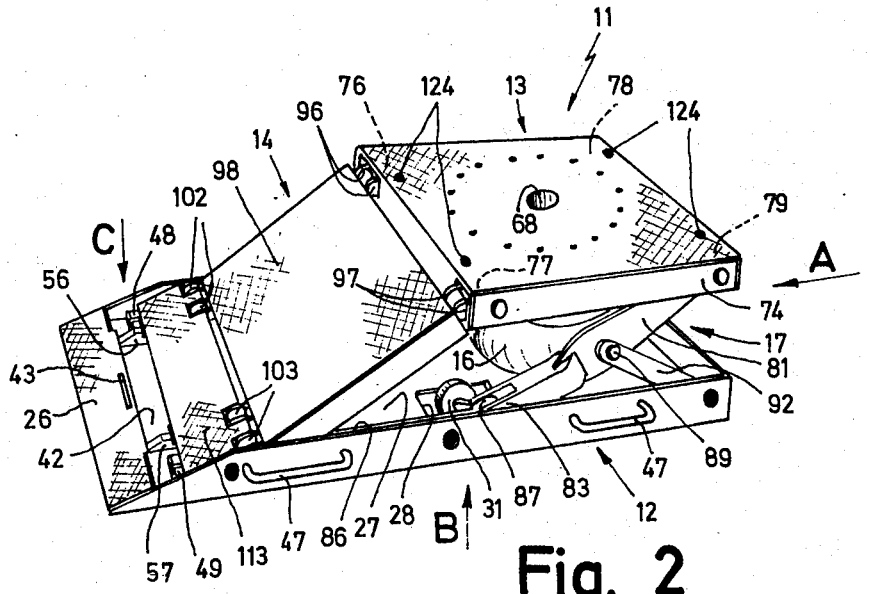
FIG. 2 shows the device without drive-off wedge in its first lift position with a short wheel fork (drawn on top) and roll-off stops (drawn on top)
Figure 3:
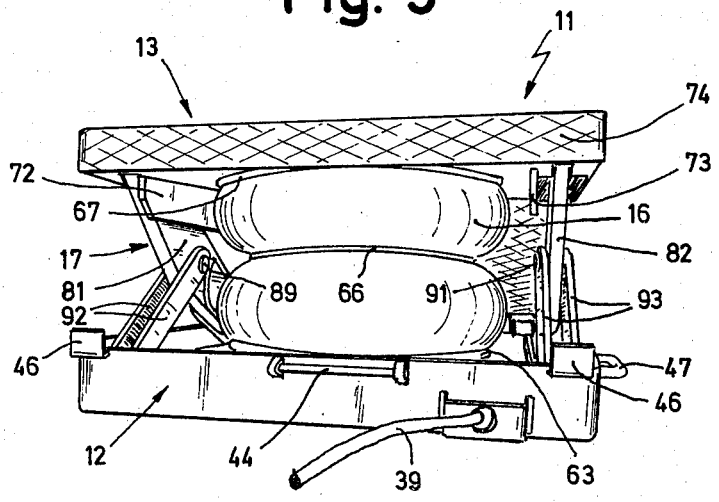
FIG. 3 shows a perspective view according to arrow A.

Among other items, a lifting wedge 11 comprises a ground frame 12, a lifting platform 13, a wedge plate 14, consisting of several parts yet to be described, an air bellows 16, a guide member construction 17 yet to be described, and, if necessary, a drive-off wedge 18.

The base area of the ground frame measures 110 × 65 cm.

Its two lengthwise struts 19, 21 form a U profile which is open in the upward direction. The rear transverse strut 22, like the middle transverse strut 23, is a square tube. The forward transverse strut 24 comprises an L profile whose cover plate 26 is a chequered plate and forms the first rigid section of wedge plate 14. On top of the transverse struts 22, 23 a first ground plate 27 is welded in at some distance from the bottom side of the ground frame 12. To the right of the transverse strut 23 and on the outside, the ground plate 27 has two clearances 28, 29. Underneath them, two wheels 31, 32 are fastened to a seat 33 which, in turn, is fastened via leaf springs 34, 36 to the bottom of ground plate 27 with screws 37. The leaf springs 34, 36 are bent downward. If a load is applied from the top to ground frame 12, wheels 31, 32 withdraw into clearance 28, 29 and the ground frame 12 rests on lengthwise struts 19, 21 and transverse struts 22, 23, 24. From the bottom, ground plate 27 is reinforced by an H-shaped square section 38 which is not shown in FIG. 8, but is much flatter than transverse struts 22, 23. Through transverse strut 22 there passes a compressed-air duct 39 which passes through the ground plate 27 underneath a protective bonnet 41 and leads upward.

A second ground plate 42 is welded into the compartment between the transverse struts 22, 24 and the lengthwise struts 19, 21 for reinforcement. The ground plate 42 runs at half the height of transverse struts 23, 24.

In the middle of cover plate 26 there is a transverse clearance 43 into which a drawbar (not shown) can be inserted; by means of this drawbar one can maneuver the unloaded lifting wedge 11 rolling on wheels 31, 32. To the transverse strut 22, there is welded for the same purpose a bridge 44 to which the drawbar also may be hitched. In the rear on transverse strut 22 two hooks 46 open to the top are welded by means of which the drive-off wedge 18 can be attached if so desired.

On the outside, at both sides of lengthwise struts 19, 21, handles 47 are welded on. Since the lifting wedge 11 weighs barely 200 kg, 4 men can easily carry it. Into the lengthwise struts 19, 21, guide bars 48, 49 are welded which are located in the center of lengthwise struts 19, 21; they are slightly less than half the length of lengthwise struts 19, 21 and have a T slot 51, 52 open on both sides. To the rear end of each guide rail 48, 49 a stop block 53 is welded. Also, at the rear end of each lengthwise strut 19, 21, in the middle, an eye 54 with horizontal through bore is located. Inside guide rails 48, 49 on the stretch between the transverse struts 23 and 24, a solid I section 56, 57 is welded, whose forward end rests against transverse strut 24. Each I section 56 has two detent recesses 58, 59 open towards the top, with vertical support surfaces 61, 62 facing the rear. The support surface 61 is relatively close to transverse strut 24 and the support surface 62 is half-way between the two transverse struts 23, 24.

Figure 4:
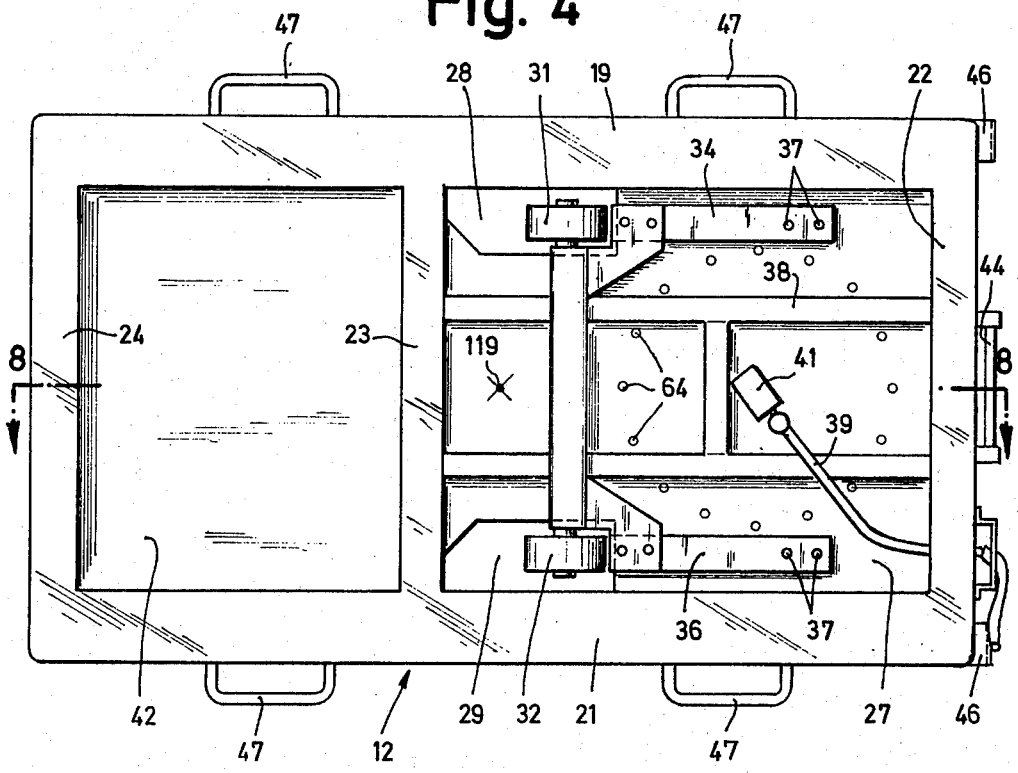
FIG. 4 shows the bottom view of the device without drive-off wedge true to scale.
Figure 5:
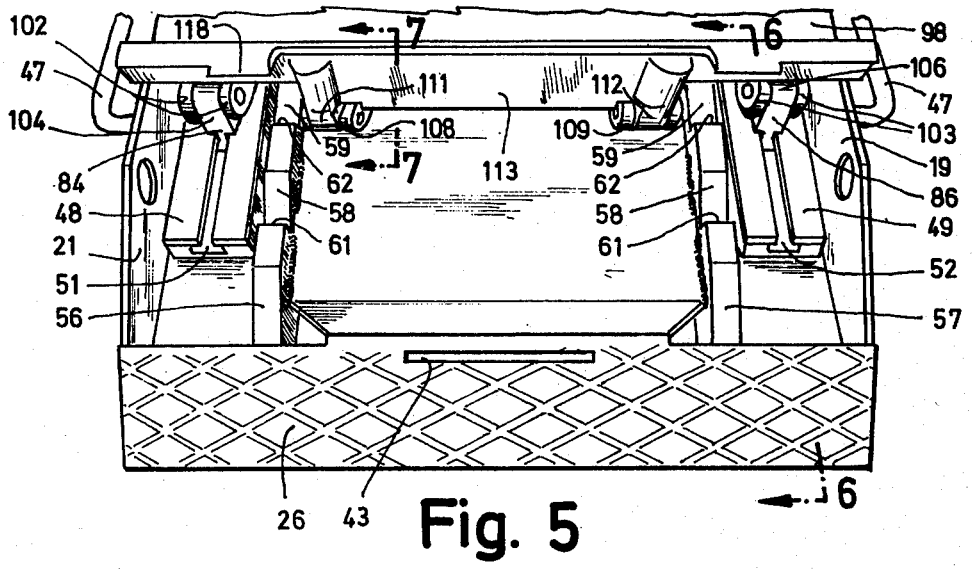
FIG. 5 shows the view according to arrow C in FIG. 2 with flipped-up forward section plate.
Figure 6:
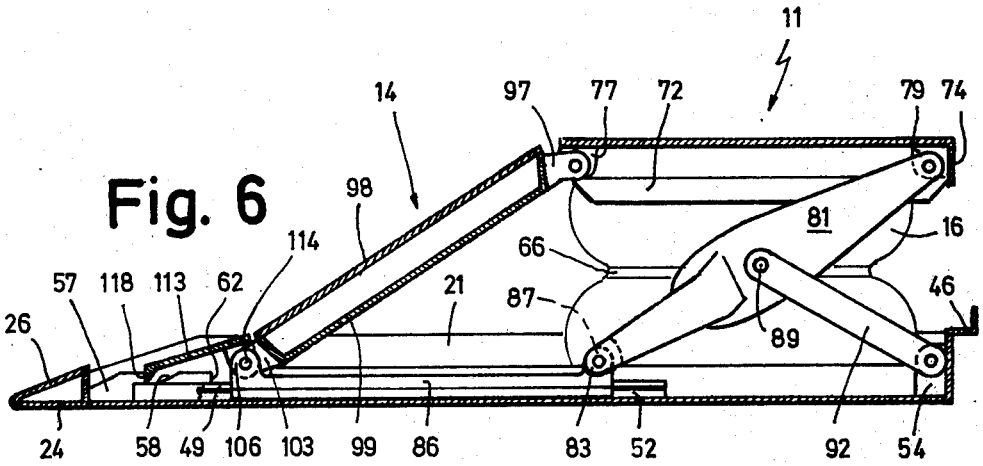
FIG. 6 shows a section taken along line 6—6 of FIG. 5.

The air bellows has a diameter of approximately 40 cm. It is a compressed-air bellows of conventional design for very heavy vehicles. Its lower edge, as customary with such air bellows, is lined with a ring 63 which is fastened air-tight from above against the ground plate 27 with screws 64 arranged in a circle. The heads of screws 64 are shown from below in FIG. 4. The air bellows 16 has an intermediate ring 66. Its upper edge also is fastened with a ring 67 from below in the exact center of lifting platform 13. To this lifting platform there is welded an airtight pot 68, accessible from the top, whose bottom, even in the extreme lowered position of the lifting platform, does not touch the ground plate. To reinforce the pot and the lifting platform 13, there are welded to the pot and the bottom side of lifting platform 13 the gusset plates 71 which are arranged radiantly but are still inside the air bellows volume. The lifting platform 13 is about 50 cm long and 65 cm wide. For further reinforcement, lengthwise running I sections 72, 73 are welded to its bottom side. When the platform is lowered, they are partially located inside lengthwise struts 19, 21. All around the lifting platform 13 has a rim 74 drawn vertically downward in a bell-shaped manner. Between the lengthwise running rim of lifting platform 13 and the I sections 72, 73 there is welded to the forward rim a pair of double bosses 76, 77 and to the rear rim a pair of double bosses 78, 79 whose bore is horizontal. The bores of the pairs of bosses are aligned with each other.

Two main levers, 81, 82 have a shape which in the vertical direction has a large area moment. In their centers, they are much wider than at their ends. The rear end of main lever 81 is located between the double bosses 79 and is pivoted there. Likewise, the rear end of main lever 82 is hinged between double bosses 78. The forward end of each main lever 81, 82 has the shape of a double boss 83 with a horizontal bore. Each double boss 82 is connected to the rear end of a rod 84, 86 which has a boss 87 at that location. Rods 84, 86 at their bottom side have a T section and hence can slide in T slots 51, 52.

Exactly in the center between the double bosses 83 on the one hand and the double bosses 78 or 79 on the other hand, each main lever 81, 82 has a transverse bore holding a crossbolt 89, 91 which projects beyond the sides of main lever 81, 82, but is shorter than the clearance width of lengthwise struts 19, 21. The crossbolts 89, 91 are seated in the forward ends of double fishplates 92, 93 whose rear ends are hinged in bosses 54. Of course, to complete the linkage, crossbolts are present (not shown). The stretches forward fulcrum — main lever / middle fulcrum — main lever / rear fulcrum — double fishplates constitute an isosceles triangle.

The forward double bosses 76, 77 of lifting platform 13 are hinged to bosses 96, 97 which are welded to a rear partial plate 98 of wedge plate 14 in its outlying area. Measured against the overall design, the partial plate 98 is extremely torsion-resistant. In accordance with FIG. 8 it has a box design with a lower bottom 99 into which additional lengthwise and crosswise U irons 101 are welded. As the drawing shows, the bosses 96, 97 project beyond the rear rim of partial (sectional) plate 98. Aligned with these bosses 96, 97 in the lengthwise direction, double bosses 102, 103 project beyond the forward rim of the sectional plate 98 and between them enclose the forward bosses 104, 106 (located in the center) of rods 84, 86. There results a parallelogram whose two horizontal sides (in relation to the geometric cross axes of the linkages) are of equal length and whose sides with up and down movement also are of equal length. But, due to the action of the double fishplates 92, 93, the geometric center axis 107 moves vertically upward. A quasi vertical motion can also be achieved by long levers. Here, however, it was achieved in an exact manner by short levers. This type of motion has the advantage that one can actuate several lever sections jointly. If the lifting platform 13 could not be moved vertically, when using several lifting wedges 11 certainly high undesirable cross forces would develop which would shift the load to be lifted and/or the lifting wedge 11. Then lifting would be possible only if all lifting devices were aligned exactly.

Figure 7:
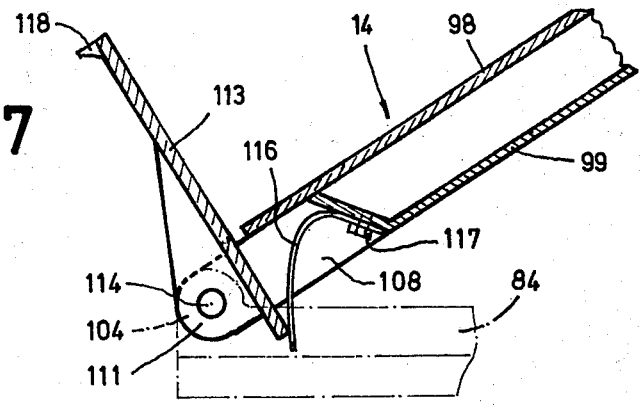
FIG. 7 shows a detail from the area forward section plate/rear section plate with the forward section plate flipped-up.

Inside the double bosses 102, 103 there are provided on sectional plate 98 another set of forward aligned double bosses 108, 109. These enclose each a boss 111, 112 which is welded to a forward sectional plate 113 from below. This forward sectional plate 113 is about 14 cm long and hence one-fourth the length as the sectional plate 98. Hinged around the geometric transverse axis 114 is sectional plate 113 which can be moved from the position shown in FIG. 8 to the position shown in FIG. 7. In the position shown in FIG. 7, the sectional plate 113 is held by two leaf springs 116 whose rear end is fastened with screws 117 to bottom 99 and which act on the rear rim of sectional plate 113. Sectional plate 113 assumes the position drawn in FIG. 8 by its own weight and the leaf springs 116 increase this force by exerting initial tension according to FIG. 7 counterclockwise, when the sectional plate 113 has the position of FIG. 8. In the hinged-down condition, the forward rim of sectional plate 113 slides on the topside of I section 56, 57. A first detent position is reached when this forward rim 118 drops behind the support surfaces 61 aligned in the transverse direction; a second detent position is reached at the highest lift condition when rim 118 drops behind support surfaces 62.

In the collapsed condition, the center of gravity 119 of the lifting wedge is located ahead of wheels 31, 32 and travels rearward, the greater the (lift) extension.

Figure 8:
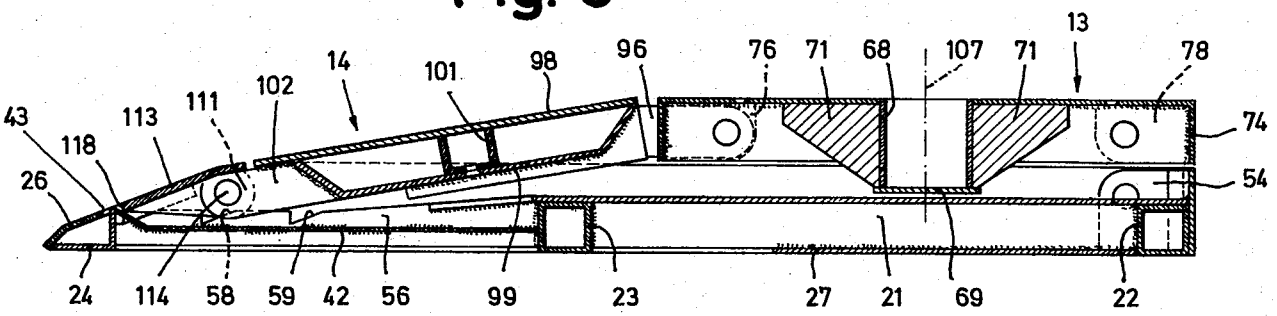
FIG. 8 shows a section taken along line 88 of FIG. 4, but without wheels.
Figure 9:
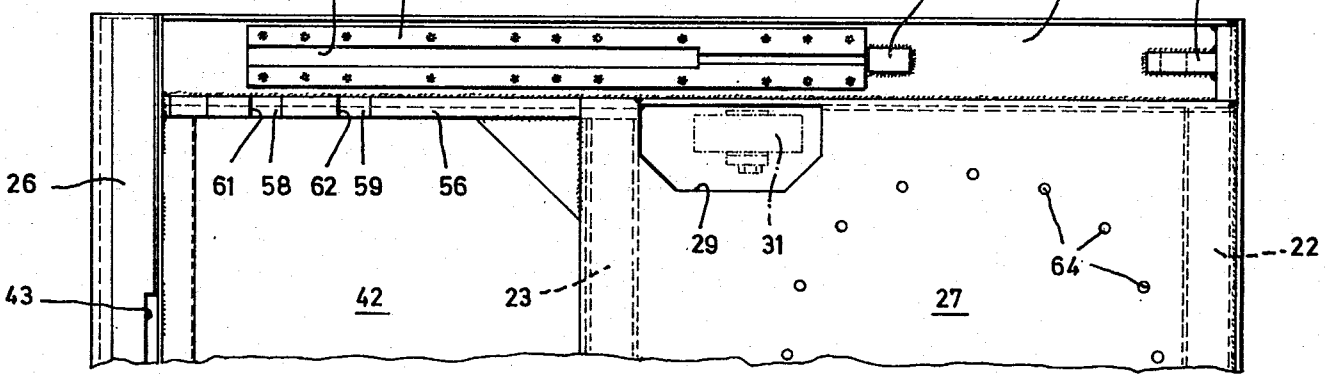
FIG. 9 is a top view of one half of the ground frame.

According to FIG. 8, the sectional plate 14 lowers first at a greater edge angle and then passes to a lower edge angle above transverse axis 114. The result is that a rolling-on wheel safely and quickly presses the wedge plate onto the ground and one has the required construction height and locking devices and linkages.

Into pot 68 there fits a cylinder 121 which may be very short or, depending on the application, may also be longer. On top it has a receiving iron 122 with which one can take hold of an axle or similar item. Other gripping elements can safely be put to use there and will only move vertically upward or downward.

At the forward rim and at the rear rim of lifting platform 13 holes 124 are provided. Into these holes fit two lugs 126 of each triangular iron 127, 128 which are inserted after the wheel has rolled onto lifting platform 13.

E.g., if one places two lifting wedges 11 underneath the rear wheels or the front wheels of a very heavy vehicle, one can, because of its overhang, easily work underneath in an almost standing (upright) position. For actuation one can use the compressed air which any heavy vehicle can easily produce itself.

The lifting wedge 11 can be easily moved even if the repair shop is crowded, because it can be slid underneath any vehicle.

I claim:

1. Device for lifting of very heavy vehicles by means of compressed air comprising:

a. a ground frame, b. a lifting platform located above an area of said ground frame, said lifting platform being at least as wide as the contact area of conventional truck twin tires and at least as long as this contact area, c. an air bellows between said lifting platform and said ground frame having a top side connected to said lifting platform and a bottom side connected to said ground frame, d. guide means pivotably connected to said lifting platform and to said ground frame, for guiding said lifting platform at right angles to said ground frame and parallel to itself, e. a wedge plate having a rearward side, pivotably connected to the drive-on side of said lifting platform and being movable up and down together with said lifting platform, and having a forward area guided by said ground frame in proximity to the ground, f. a disconnectable locking device for securing said lifting platform against lowering at a predetermined elevation of said lifting platform, and g. wheels for moving said device which under vehicle load assume an alternate position.

2. The device according to claim 1 in which said ground frame has underneath said air bellows an airtight plate means fully in contact with said air bellows, which plate means reinforces the ground frame and constitutes the ground plate for mounting the lower peripheral area of said air bellows.

3. The device according to claim 2 in which said ground plate is spaced from the bottom side of said ground frame.

4. The device according to claim 1 in which said lifting platform is connected above said air bellows airtight and constitutes the cover plate for mounting the upper peripheral area of said air bellows.

5. The device according to claim 1 in which said air bellows is a compressed-air bellows conventional with air-suspension vehicles, which air bellows is open at its ends and has mounting rings for securing its rim to a ground plate and to said lifting platform.

6. The device according to claim 1 in which said air bellows is located in the exact center and beneath said lifting platform.

7. The device according to claim 1 in which the minimum design height is determined by the height of said ground frame plus the height of said lifting platform.

8. The device according to claim 2 in which the distance between the top side of said plate device and the bottom side of said lifting platform is determined by the minimum design height of said air bellows having a single intermediate ring.

9. The device according to claim 1 in which in continuation of said wedge plate in the direction towards the ground, a narrow wedge strip with a box section, is rigidly fastened to said ground frame.

10. The device according to claim 1 in which two wheels are located next to each other on said device, said wheels having an axis of rotation, seen from the forward side of said wedge plate, located behind the overall center of gravity of the entire device when the latter has its lowest height.

11. The device according to claim 1 in which the mean (average) wedge angle is about 15° and at the most 20°.

12. The device according to claim 1 in which the wedge area, seen from the top, is about as large as the area of said lifting platform.

13. The device according to claim 1 in which said locking device comprises detents cooperating with a forwardly disposed edge on said wedge plate which is lockable behind said detents, which detents are immovable in the lengthwise direction of the device and are connected shear-free to said ground frame.

14. The device according to claim 13 in which said detents are rigidly connected to the ground frame and said forwardly disposed edge on said wedge plate can be moved up and down.

15. The device according to claim 14 in which said wedge plate comprises two plate sections, the rear plate section being several times the length of the forward plate section, the rear edge of the rear plate section being immovable in the horizontal direction, the forward plate section being hinged to the forward edge of the rear plate section and can be moved up and down at its forward edge about the hinge axis.

16. The device according to claim 15 in which a spring device can lock said forward plate section in its upper position, disconnected from detents.

17. The device in accordance with claim 15 in which said forward plate section with its forward edge is preferably moved by its own weight. ;

18. The device in accordance with claim 1 in which the device height is approximately 10–20 cm., preferably 15 cm.

19. The device in accordance with claim 1 in which said guide means comprises linkage means which draws the forward edge area of said wedge plate, vertically immovable, during the rise of the lifting platform.

20. The device in accordance with claim 1 in which said guide means comprises a horizontally guiding portion, said lifting plate and said wedge plate each form one side of a parallelogram, a main lever forms the third side of the parallelogram, said main lever having a high bending moment in the vertical direction; the rear end of said main lever is hinged in the rear area of said lifting platform and the forward end is hinged to said horizontal guiding portion; guide rods forming the fourth side of the parallelogram, said guide rods extending from the forward end of said main levers to the forward area of the said wedge plate, which is vertically immovable.

21. The device according to claim 20 in which said horizontal guiding portion is pivotably connected to said wedge plate.

22. The device according to claim 20 in which said horizontal guiding portion includes lengthwise guide rails rigidly connected to said ground frame and said guide rods are guided by these rails.

23. The device according to claim 20 in which for parallel and vertical guidance for said lifting platform, steering levers are provided whose rear end is hinged in the rear area of said ground frame lower than the pivot axis of said main levers and in straight extension of said guide rod, and whose forward end is hinged at said main levers in their effective center and wherein the effective length of said steering levers is exactly equal to the effective length of the main lever from the pivot axis of said main lever and said steering lever to the pivot axis of said main lever and said horizontal guiding portion.

24. The device according to claim 23 in which each steering lever comprises two parallel shackles which are spaced apart and between which said main lever is accommodated.

25. The device according to claim 23 in which said ground frame has on its outward sides lengthwise hollow sections open at least in the upward direction, which hollow sections can accommodate at least up to part of their height said main lever, said horizontal guiding portion and said steering levers.

26. The device according to claim 1 in which the majority of moving joints are symmetrical joints.

27. The device according to claim 13 in which at least two pairs of detents are provided whose position corresponds to two different working elevations of said lifting platform.

28. The device in accordance with claim 1 in which in the center region of said lifting platform coaxially with the air bellows, there is provided a blind recess to accommodate a fitting of load lifting members such as a horn plate and the like.

29. The device in accordance with claim 1 in which preferably on both of said sides of said lifting platform there are located mounting supports for roll-off blocks.

30. The device according to claim 1 in which at the rear end of the device an inactive drive-off wedge is attached.

31. The device according to claim 1 in which at the forward and rear ends of the device a hitching location for a removable drawbar is provided.

32. The device according to claim 20 in which the obtuse parallelogram angle in its first lifting position is 130°–145° and in its second lifting position is 125°–110°.

33. The device according to claim 1 in which the height of the device in the lowest condition is about 15 cm, at the highest elevation is 40–50 cm, preferably about 45 cm, and in the middle position is 31–41 cm, preferably about 36 cm, with the load capacity in the first case at about 6,000 kp and in the second case about 4,000 kp.

34. The device according to claim 1 in which only a single air bellows is provided.

35. The device according to claim 1 in which at least that section of said wedge plate constituting part of the parallelogram has a rigid box section.

* * * * *